United States Patent [19]

Petrenchik

[11] Patent Number: 4,641,702

[45] Date of Patent: Feb. 10, 1987

[54] METHOD AND MOLD FOR MOLDING INVESTMENT CASTING PATTERNS OF IRREGULAR SHAPE

[75] Inventor: John R. Petrenchik, Pepper Pike, Ohio

[73] Assignee: Mercury Machine Company, Warrensville Heights, Ohio

[21] Appl. No.: 716,961

[22] Filed: Mar. 28, 1985

[51] Int. Cl.[4] ..... B22C 7/02

[52] U.S. Cl. ..... 164/137; 164/246

[58] Field of Search ..... 164/8, 34, 36, 45, 165, 164/137, 13, 32, 168, 222, 232, 245, 246, 247, 248, 339, 341, 342, 346; 249/134, 61, 62; 264/219, 221, DIG. 44

[56] References Cited

U.S. PATENT DOCUMENTS

| | | | |
|---|---|---|---|
| 2,782,477 | 2/1957 | Bean | 164/32 |
| 3,192,578 | 7/1965 | McCormick . | |
| 3,351,691 | 11/1967 | Wilford . | |
| 3,425,092 | 2/1969 | Taga . | |
| 3,431,967 | 3/1969 | Hipp, Jr. . | |
| 3,448,497 | 6/1969 | Arnold et al. . | |
| 3,463,844 | 8/1969 | Griffin . | |
| 3,492,690 | 2/1970 | Goldring et al. . | |
| 3,604,497 | 9/1971 | Sylvester | 164/137 |
| 3,752,437 | 8/1973 | Saidla . | |
| 3,782,679 | 1/1974 | Ward | 164/339 |
| 3,873,056 | 3/1975 | Parkinson . | |
| 3,966,386 | 6/1976 | Beyer et al. . | |
| 4,073,609 | 2/1978 | Petrenchik | 164/232 |
| 4,083,910 | 4/1978 | Tits et al. . | |
| 4,125,246 | 11/1978 | von Holdt . | |
| 4,136,150 | 1/1979 | Darnall, Jr. . | |
| 4,209,160 | 6/1980 | Vanotti . | |
| 4,535,831 | 8/1985 | Sato | 164/34 |

*Primary Examiner*—Nicholas P. Godici
*Assistant Examiner*—G. M. Reid
*Attorney, Agent, or Firm*—Baldwin, Egan & Fetzer

[57] ABSTRACT

A method and a die mold for molding destructible investment casting patterns of irregular shapes such as, for instance, investment casting patterns utilized in the production of vane sections for a jet engine turbine, or the like. The die mold comprises a mold cavity defined by surfaces extending arcuately in non-parallel relation, and includes a plurality of separable mold portions including rear, front, and side mold portions preferably movable outwardly with respect to one another and with respect to a mounting base, and also including coacting movable mold cavity insert portions disposed intermediate the first mentioned mold portions, and defining arcuate surface sections of the mold cavity. The invention is characterized by the ability to remove the mold cavity insert portions from the pattern after the molding of the pattern in the mold cavity, and by moving said cavity insert portions through a generally arcuate path with respect to the confronting pattern surfaces, thus accomplishing removal of the mold cavity insert portions without interference with the confronting arcuate surfaces of the pattern, after which removal of the pattern from the die mold can be accomplished. The method of the invention involving arcuate movement of the mold cavity insert portions with respect to the formed pattern is accomplished manually.

14 Claims, 20 Drawing Figures

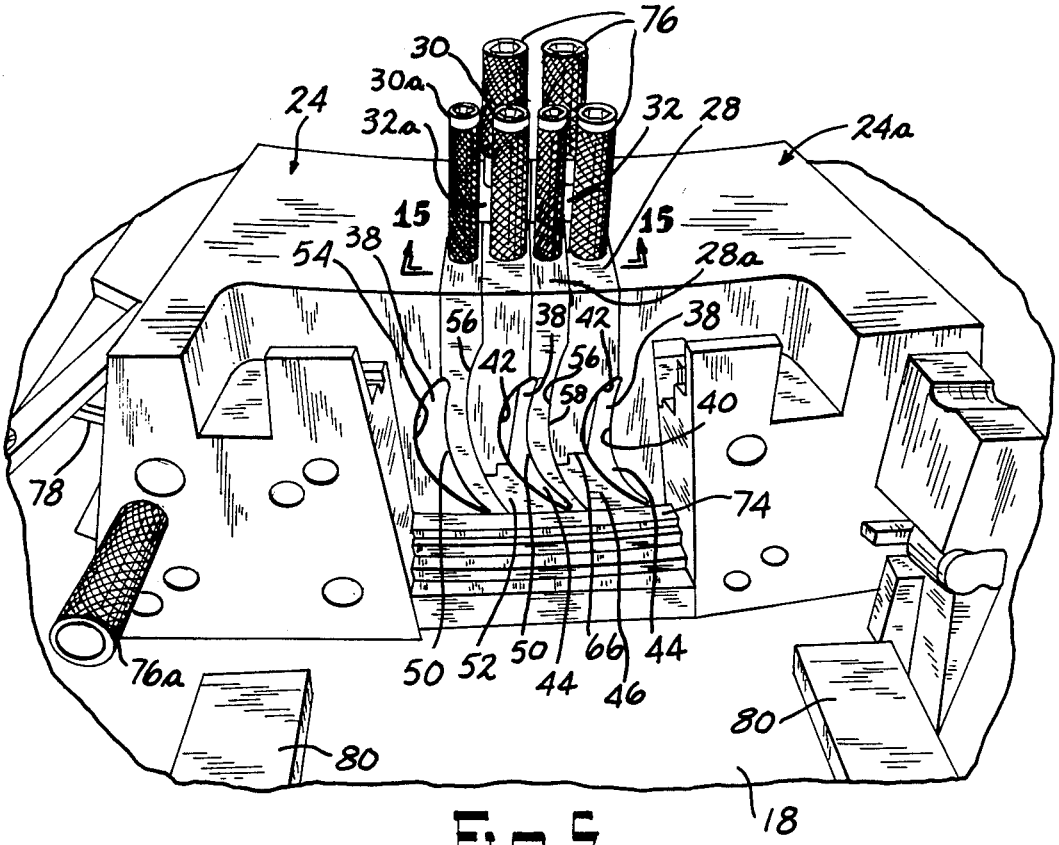
Fig 5
Fig 6
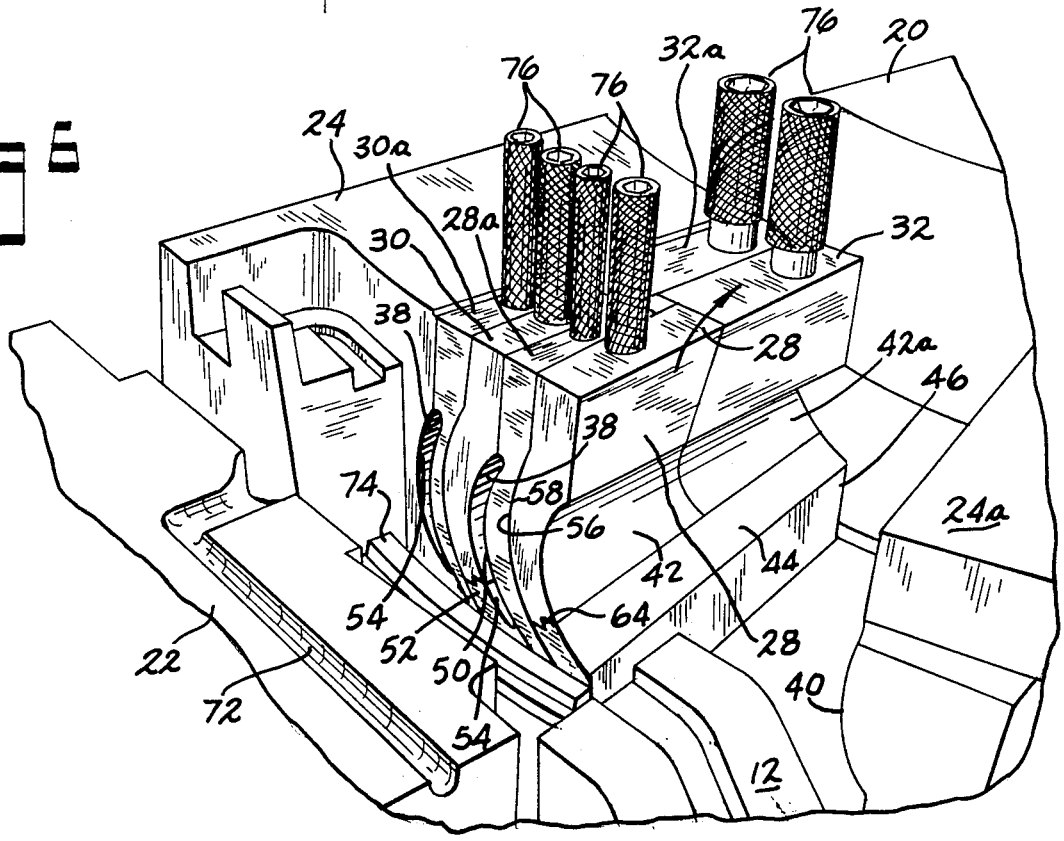

METHOD AND MOLD FOR MOLDING INVESTMENT CASTING PATTERNS OF IRREGULAR SHAPE

SPECIFICATION

The invention relates in general to die molds for forming investment type patterns of irregular shape, and more particularly to a method and die mold for forming investment type patterns of irregular shape having defining surfaces extending arcuately in the same general direction but in generally non-parallel relation and wherein the mold and the method provide for removal of the die mold cavity insert portions which define the arcuate surface sections of the casting pattern mold cavity by moving the cavity insert portions through generally arcuate paths and with respect to the formed pattern, without interference with the latter, thus providing for removal of the cavity insert portions from the pattern and providing for subsequent removal of the formed pattern from the die mold.

BACKGROUND OF THE INVENTION

Heretofore it has been difficult to provide a die mold for casting investment type patterns of irregular shapes since the arcuate surfaces of such shapes lay or extend in non-parallel relation and thus are disposed at different angles, and removal of the defining mold sections defining the mold cavity for the formed pattern presents considerable problems in the design of the mold. This especially becomes a problem when the investment type casting pattern includes a plurality of relatively close side-by-side vanes or blades connected by end shroud portions, so that removal of the investment-type pattern after it has been molded, from the die mold, has been extremely difficult or not feasible. The usual prior art molds for forming multi-vane investment casting patterns are not satisfactory and generally result in interference between movable die mold sections defining the pattern cavities and the formed pattern, during disassembly of the die mold to remove the pattern from the mold.

U.S. Pat. No. 4,073,609 issued Feb. 14, 1978 to John R. Petrenchik and entitled Apparatus for Molding Irregular Shapes discloses a mold which includes swing lever block portions for facilitating movement of the die mold sections defining in part a casting pattern, for removal of the casting pattern from the die mold. However, such apparatus is not feasible especially when attempting to form a casting pattern of irregular shape which includes a plurality of irregular shaped blades or vanes disposed in generally spaced but side-by-side extending relationship.

SUMMARY OF THE INVENTION

The present invention provides a novel mold apparatus and method for molding investment-type casting patterns of irregular shape and particularly those which include a plurality of relatively closely spaced generally side-by-side blades or vane sections, and wherein the die mold includes separable mold portions, including movable mold cavity insert portions defining arcuate surface sections of the casting pattern mold cavities with the curvatures of each cavity thereof extending arcuately in non-parallel relation, and which provides for removal of the mold cavity insert portions from the pattern after the formation thereof, by moving each of the mold cavity insert portions in a generally arcuate path with respect to the confronting arcuate surfaces of the pattern, thus accomplishing removal of the cavity insert portions without interference with the formed pattern, and providing for subsequent removal of the formed pattern from the die mold.

Accordingly, an object of the invention is to provide a novel method for molding investment-type casting patterns of irregular shape and especially casting patterns having a plurality of blades or vanes embodied therein extending in generally side-by-side spaced relationship.

Another object of the invention is to provide a method of the aforesaid type which includes the step of moving the mold cavity insert portions which define arcuate surface sections of the casting pattern, through generally arcuate paths with respect to the confronting arcuate surfaces of the pattern, thus accomplishing removal of the cavity insert portions from the die mold without interference with the formed pattern, and thus provide for subsequent removal of the pattern from the die mold.

A still further object of the invention is to provide a die mold apparatus for molding investment-type casting patterns of irregular shape, with the die mold including cavity insert portions defining arcuate surface sections of the investment pattern mold cavity with the curvatures thereof extending arcuately in generally non-parallel relation, and wherein the cavity insert portions are so constructed and arranged that they may be moved through generally arcuate paths to accomplish removal of the cavity insert portions from the die mold without interference with the formed casting pattern, thus providing for the subsequent removal of the casting pattern from the die mold.

A further object of the invention is to provide a mold apparatus of the latter mentioned type wherein the cavity insert portions comprise a plurality of generally side-by-side die mold block members having thereon defining arcuate surfaces for delineating a casting pattern cavity, with each block member defining a portion of the cavity, and with the cavity insert portions having means thereon for interlocking the same with respect to elongated mold rib sections defining a predetermined lower concave section of the cavity of the die mold, so that upon generally arcuate movement of the cavity insert portions from the confronting arcuate surfaces of the pattern the pattern is exposed for removal from the die mold.

Other objects and advantages of the invention will be apparent from the following description taken in conjunction with the accompanying drawings wherein:

BRIEF DESCRIPTION OF THE DRAWINGS

FIG. 5 is a generally perspective, enlarged illustration looking at the front end of the aforementioned cavity insert portions of the die mold assembly after outward or rearward movement of the outer shroud mold portion back away from the remainder of the die mold in the disassembly thereof;

FIG. 6 is a generally perspective view taken from the righthand front corner of the die mold as compared to that of FIG. 5, and with the righthand radial end mold portion having been moved outwardly away from the confronting side of the cavity insert portions of the die mold, to expose one of the blade or vane cavities defined by the cavity insert portions, the elongated mold rib sections on which certain of the cavity insert portions are mounted, and the aforementioned righthand radial end mold portion;

FIG. 10 is a generally perspective view similar to FIGS. 7 and 8 but showing the initiation of removal of another of the cavity insert portions of the die mold by first moving such cavity insert portion linearly toward the forward end of the mold and with respect to its associated elongated rib section defining the die mold cavity, and then arcuately outwardly away from the confronting arcuate surfaces of the pattern (not shown) to accomplish removal of such cavity insert portion from the pattern and from the other mold components, without interference;

DESCRIPTION OF PREFERRED EMBODIMENT

Figure 9B:
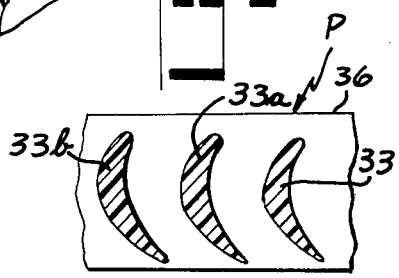
FIG. 9*b* is a sectional view taken generally along the plane of line 9*b*—9*b* of FIG. 9 looking in the direction of the arrows.
Figure 9A:
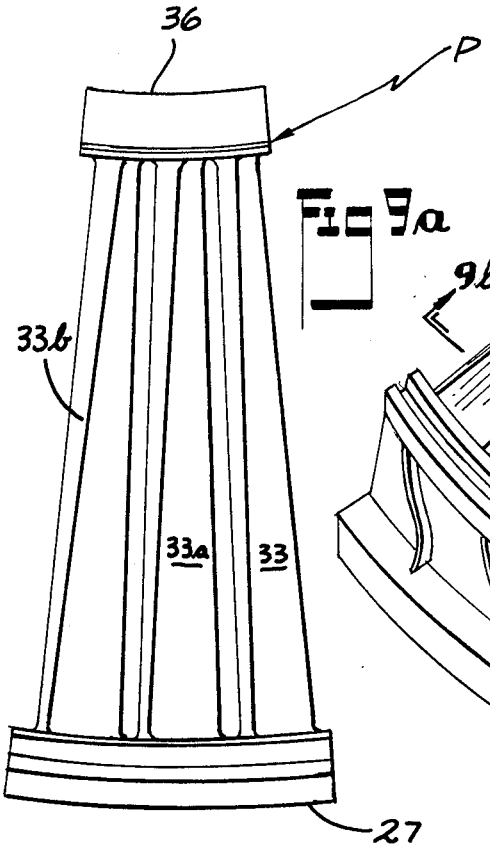
FIG. 9*a* is a top plan view of the investment-type pattern of FIG. 9.
Figure 9:
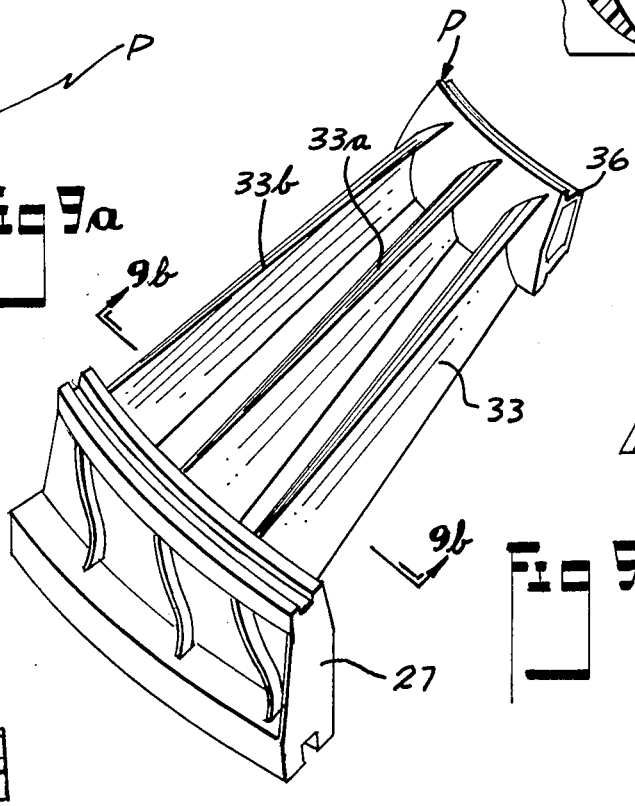
FIG. 9 is a generally perspective view of the investment-type casting pattern formed in the die mold assembly illustrated in FIGS. 1–8.
Figure 9C:
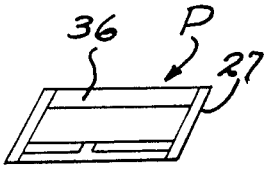
FIG. 9*c* is a reduced size end view of the investment pattern of FIGS. 9–9*b* taken from the inner shroud end of the pattern (the end of the pattern having the lesser radius)
Figure 14:
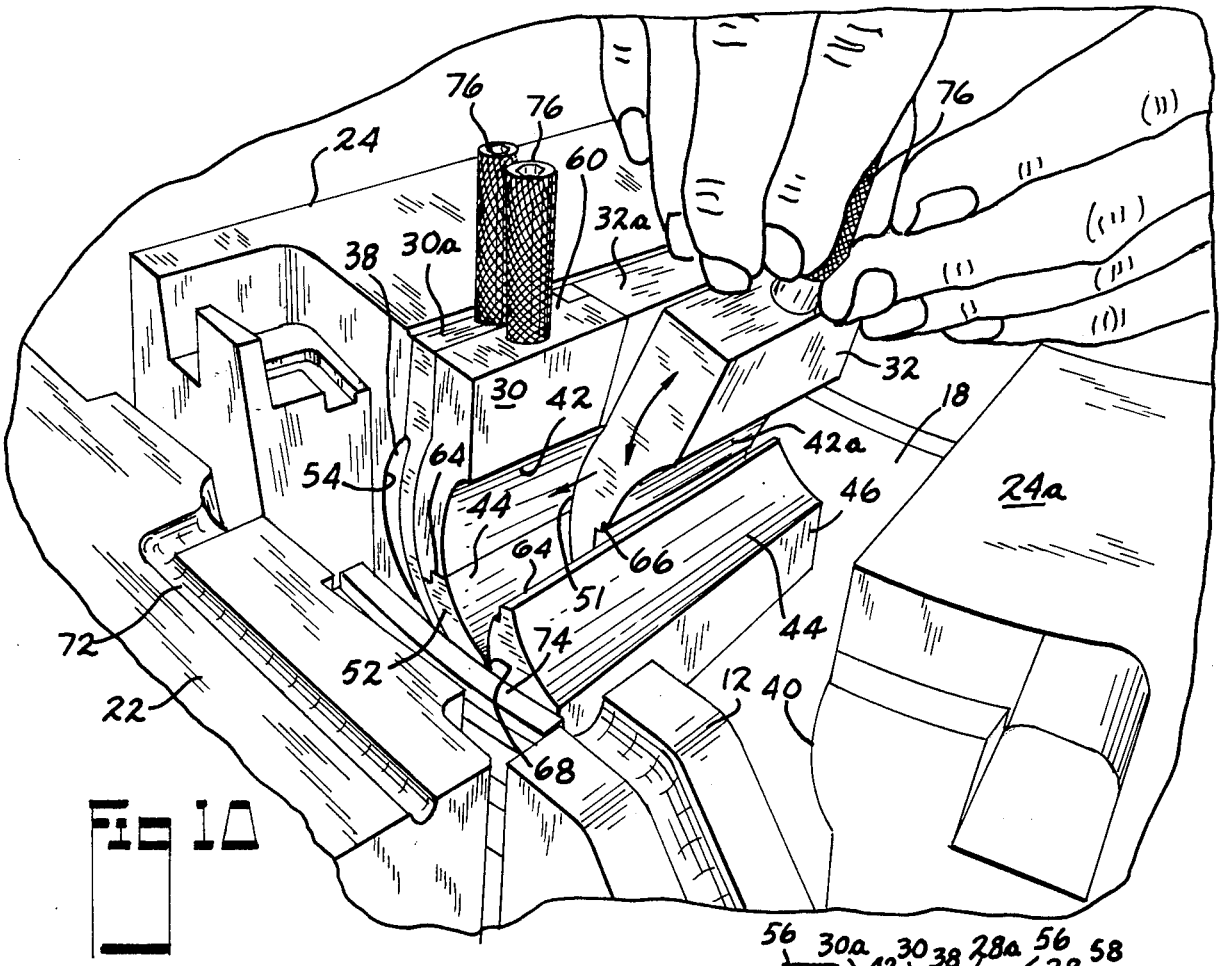
FIG. 14 is a view of the die mold in the condition illustrated in FIG. 13, but taken from the forward righthand corner of the die mold assembly and likewise illustrating the cavity defining ribs of the die mold.

The investment-type casting pattern described herein and illustrated for instance in FIGS. 9 through 9*c* is for use in producing a vane cluster for a jet engine or the like. However, it will be understood that this invention may also be applied to parts of various other forms which may include blades or vanes or various other configurations, so long as it is not generally feasible to merely withdraw the die parts linearly from the mold assembly so as to release the investment-type pattern from the die mold.

Figure 1:
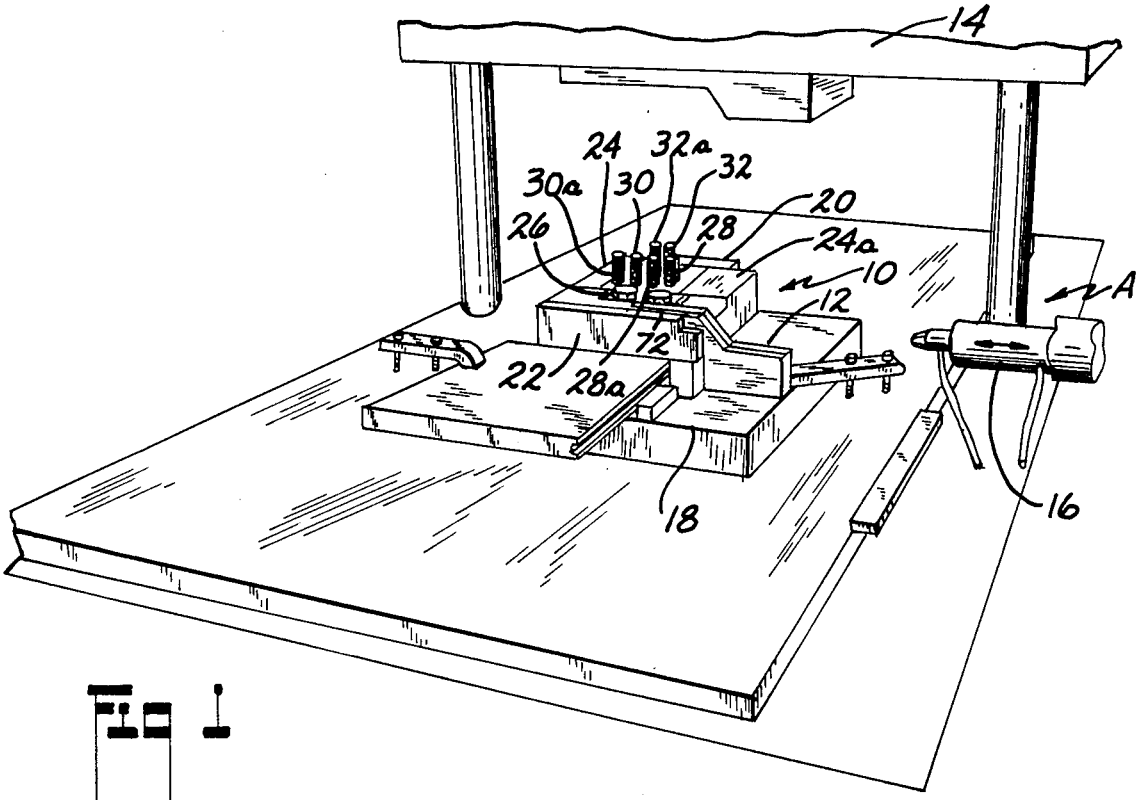
FIG. 1 is a generally perspective, fragmentary illustration of an assembled die mold for forming investment-type patterns of irregular shape and embodying the invention, with the die mold being disposed at a molding station for injection of thermoplastic resin or wax therein to form the pattern in the mold.

Reference number 10 refers to a die mold embodying the invention, and as illustrated in FIG. 1 is disposed at an injection station A wherein liquid wax or other low temperature thermoplastic material, such as for instance known synthetic resinous material, is adapted to be injected into the die mold in the process of formation of an investment-type pattern. The low temperature destructible material is adapted to be injected into the die mold by any suitable means and in the embodiment illustrated via the injection channel 12, when the die mold is coacting with the movable upper platen 14, which is adapted to be lowered into engaged relationship with the underlying die mold during the injection process. An injector 16 of conventional well known type can be provided for actually inserting the low temperature destructible substance into the die mold in the formation of the investment-type pattern.

In the embodiment illustrated, the die mold 10 includes a support or base platform 18 on which the various mold portions are movably mounted to define the mold cavity or cavities in which the investment-type irregular shaped pattern is formed. These mold portions comprise, in the embodiment illustrated, an inner shroud mold portion 20, an outer shroud mold portion 22 and lefthand and righthand radial end mold portions 24 and 24*a*. Outer shroud mold portion 22 in the embodiment illustrated includes a separable top plate section 26. Section 26 of outer mold portion 22 is supported on and coacts with mold portions 24, 24*a* to define the mold cavity portion that forms the outer shroud section 27 of the formed pattern P which will be hereinafter described in detail.

Disposed intermediate the inner and outer shroud mold portions 20, 22 and the left and righthand radial end mold portions 24, 24*a* are a plurality of cavity insert mold portions 28, 28*a*, 30, 30*a*, 32, and 32*a*, with such insert portions coacting with one another and with the inner and the outer mold portions 20, 22 and the radial end mold portions 24, 24*a*, to define in part the mold cavities which provide for the formation of the investment-type pattern P illustrated for instance in FIGS. 9 through 9*c*.

Mold cavity insert portions 28, 28*a*, 30, 30*a*, 32, 32*a* define in part the blade or vane portions 33, 33*a*, 33*b* of the investment pattern, and are so constructed and arranged that after completion of the formation of the investment pattern in the die mold, such cavity insert portions can be moved through generally arcuate paths with respect to the confronting arcuate surfaces of the formed pattern and with respect to the other components of the mold, so as to remove the cavity insert portions without interference with the pattern or the other mold components, and thus provide for subsequent removal of the formed pattern from the mold. The method of doing just that and the die mold apparatus for accomplishing just that are the essence of this invention.

The investment-type pattern P as can be best seen in FIGS. 9–9*c* comprises an inner shroud section 36 and the aforementioned outer shroud section 27, with inner shroud section 36 being of a lesser radius of curvature as compared to the outer shroud section 27. Connecting the inner and outer shroud sections are a plurality of the aforementioned relatively closely adjacent blades or vanes 33, 33*a*, 33*b* which in vertical section are of arcuate configuration (FIG. 9*b*) defined by curving lines disposed in generally vertical, non-parallel relation, and with the vanes or blades 33–33*b* being generally twisted about their lengthwise axes, as they extend from the front shroud section 27 to the rear shroud section 36 and as can be best seen from FIG. 9*a*. Moreover, the spacing between the vanes at the front shroud is greater than at the rear shroud, as may also be seen from FIG. 9*a*, whereby the vanes extend generally radially in their lengthwise direction.

Referring now particularly to FIG. 5 which is a generally front end view of the cavity insert portions defining the die mold cavities 38 in which the vanes of the investment pattern are formed and as disposed in the mold assembly, it will be seen that in the embodiment illustrated the righthand vane cavity is defined partially by the convex surface 40 on the righthand mold portion 24*a* and partially by the concave surface portions 42, 42*a* on respectively cavity insert portion 28 and rearward cavity insert portion 32 (FIG. 6), and partially by the concave surface 44 (FIG. 6) on elongated mold rib portion 46 with which the cavity insert portions 28, 32 and the righthand end mold portion 24*a* coact in engaged relation when the mold is in assembled condition ready for receiving therein the wax or other destructive material for formation of the investment pattern.

The next adjacent die mold cavity 38 defining the adjacent vane or blade 33*a* of the pattern P is defined by the convex surface section 50 on the corresponding side of cavity insert portion 28*a* and by the convex surface 51 on the adjacent rearward cavity insert portion 32, by the concave section 42 on the cavity insert portion 30 and the concave section 42*a* on the adjacent rearward cavity insert portion 32*a*, and by the concave portion 44 on the underlying mold rib portion or section 52 which is fixed to the platform 18 of the die mold assembly adjacent to aforementioned mold rib portion 46.

The next adjacent mold cavity is defined by the convex surface portion 50 on the adjacent cavity insert portion 30*a* and by the convex surface 51 on the adjacent rearward cavity insert portion 32*a* and by the concave surface 54 in the lefthand radial end mold portion 24.

As can be best seen in FIGS. 6 through 12, the aforementioned cavity insert portions 28, 28*a*, 30, 30*a*, in the embodiment illustrated, define the vane mold cavities for the approximate forward half of the lengthwise extent of each respective vane of the pattern, while the rearward half of the lengthwise extent of the mold cavities defining the vanes is provided by the cavity insert portions 32 and 32*a* coacting with the respective pair of frontal cavity insert portions 28, 28*a* and 30, 30*a*, and with the respective end mold portion 24, 24*a*.

Referring now in particular to FIGS. 5, 8 and 15–17, it will be seen that each mold cavity insert portion 28 or 30 has on one side thereof a convex portion 56, while the confronting side of each coacting mold cavity insert portion 28*a* or 30*a* has a concave surface 58 thereon, formed complementary to the surface 56, so that when the mold cavity insert portions 28, 28*a* and 30, 30*a* are mounted in the mold assembly to define the mold cavities thereof, convex portion 56 on mold cavity insert portion 28 or 30 is generally snugly received in the concave portion 58 on the respective mold cavity insert portion 28*a* or 30*a*. Moreover, each insert portion 28 or 30 preferably has on the upper end thereof a laterally projecting lug 60 (FIGS. 10 and 17) which is adapted to be received generally snugly within a complementary recess 62 (FIG. 16) for interlocking the respective pair of mold cavity insert portions 28, 28*a*, and 30, 30*a* together.

Figure 15:
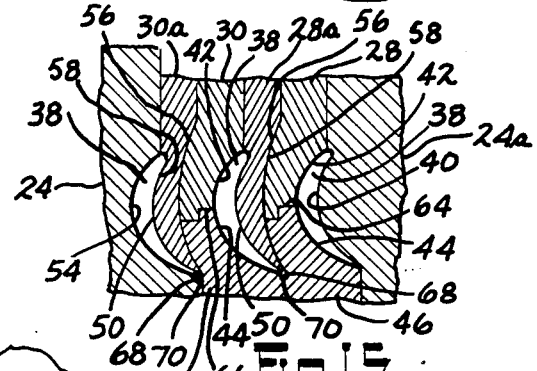
FIG. 15 is a fragmentary sectional view taken generally along the plane of line 15—15 of FIG. 5 of the die mold cavities as defined by the laterally movable mold portions and the cavity insert portions, coacting with the aforementioned ribs, to define the mold cavities, and illustrating the interlocking coaction between various of the cavity insert portions and the ribs.
Figure 16:
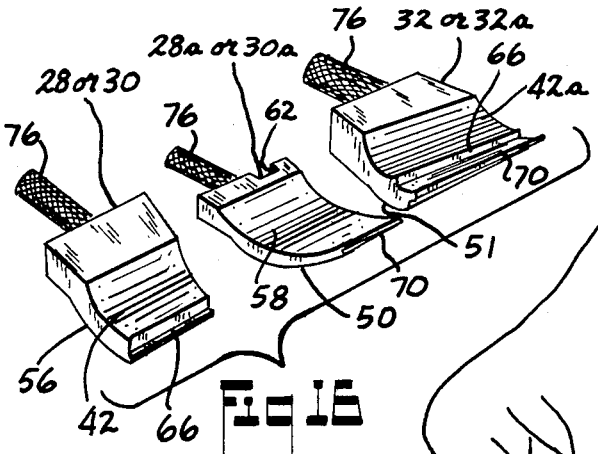
FIG. 16 is a perspective view illustrating the three configurations of cavity insert portions utilized in the die mold assembly illustrated in the drawings.
Figure 17:
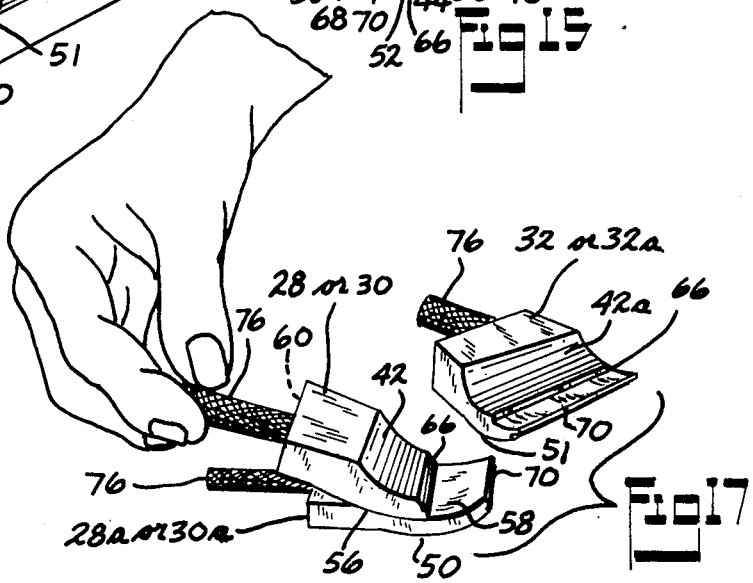
FIG. 17 is a diagrammatic illustration of the coaction between a pair of the frontal cavity insert portions which partially define the respective investment casting pattern cavity, and showing the arcuate surfaces thereof which coact to aid in maintaining such cavity insert portions in assembled relationship with respect to one another, and yet provide for the generally arcuate movement of the cavity insert portions relative to the pattern and relative to one another during removal of the respective cavity insert portion from the die mold; the cavity insert portion shown on the righthand side of FIG. 17 represents a typical rearward insert portion of the cavity insert member assembly.
Figure 11:
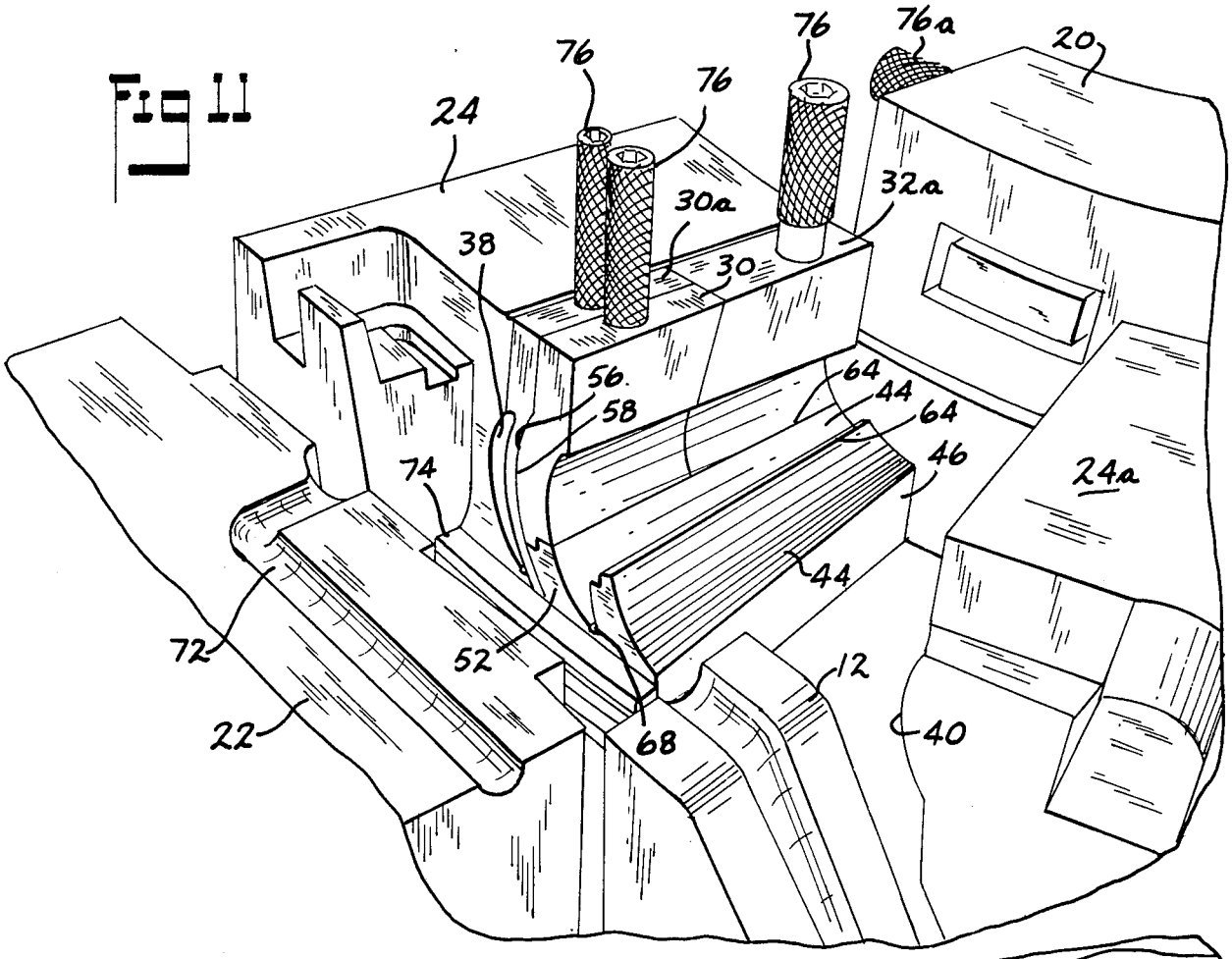
FIG. 11 is a view generally similar to that of FIG. 10 but showing the remaining cavity insert portions of the die mold after removal of the insert portion illustrated in FIG. 10.
Figure 12:
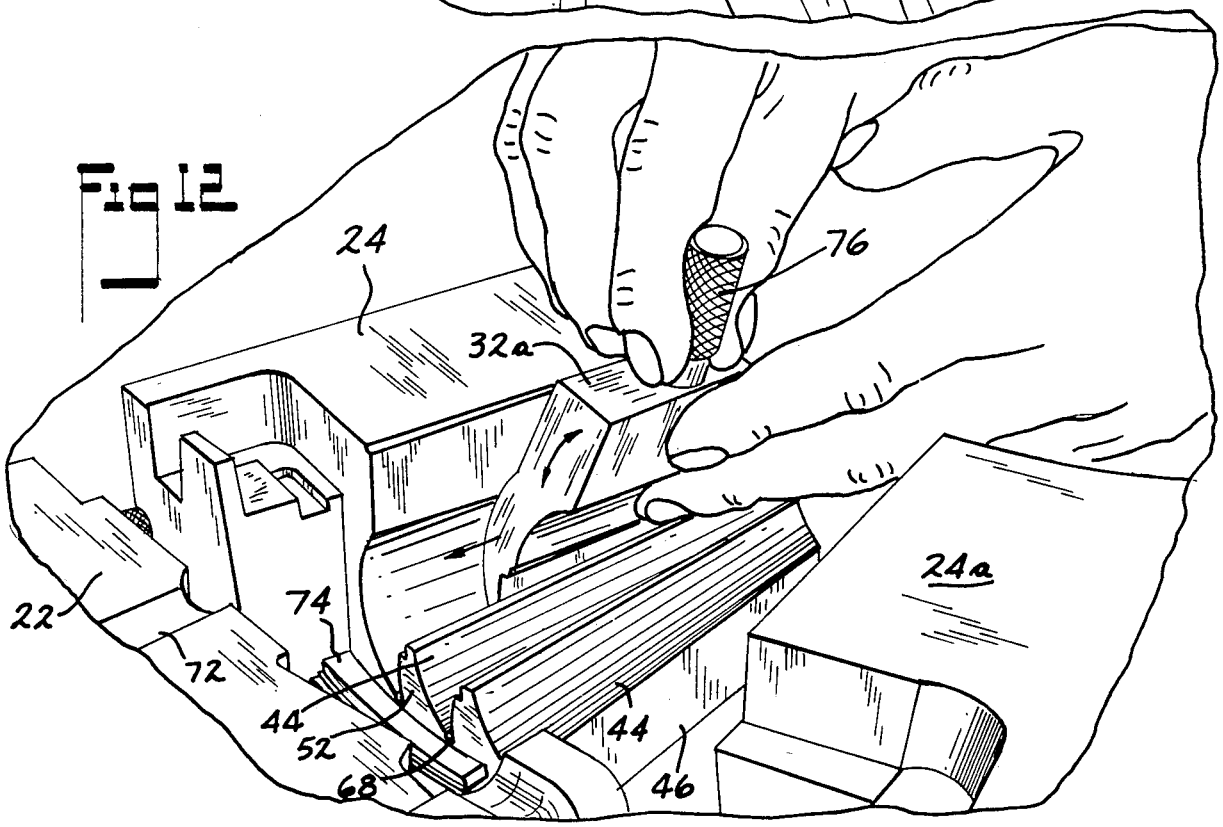
FIG. 12 is a perspective view generally similar to that of FIG. 11 but illustrating removal of the last rearward cavity insert portion from the die mold and from its mounted coaction on the associated cavity defining elongated rib section after all of the other cavity insert portions have been removed.
Figure 13:
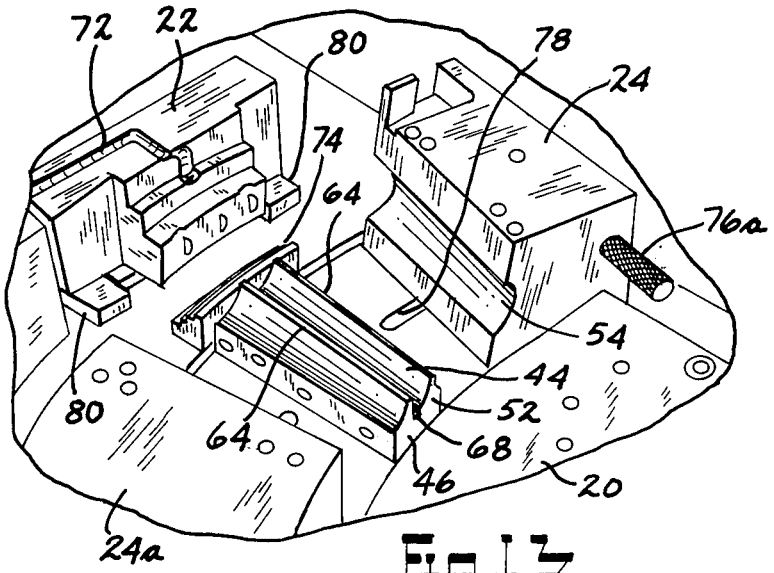
FIG. 13 is a perspective view taken from generally the rear righthand corner of the die mold assembly after removal of all of the cavity insert portions and the movement of the lefthand radial mold end portion away from the aforementioned mold ribs formed on the platform of the die mold, and which coact with the cavity insert portions to define the mold cavities of the die mold.
Figure 14:
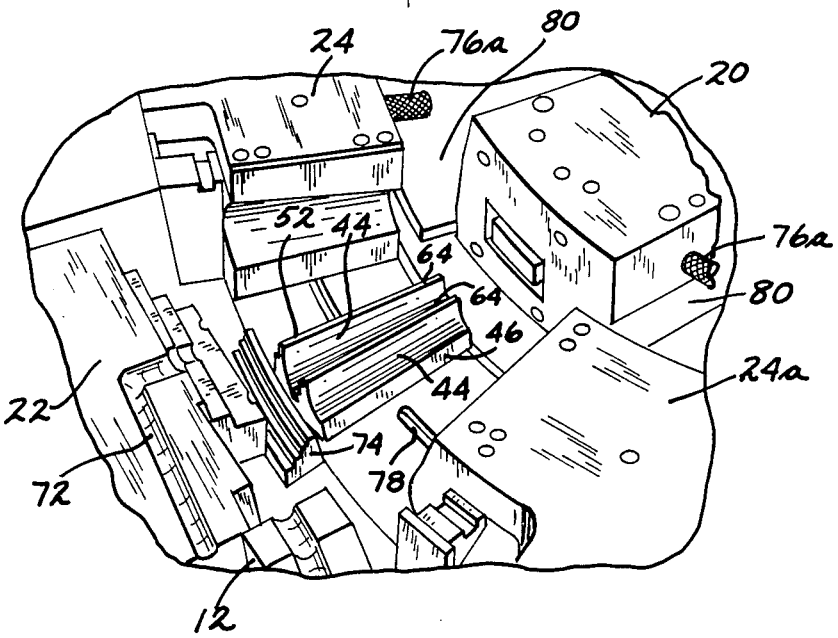

Each of the elongated rib sections 46, 52 on the platform 18 has, on its upper portion, a stepped configuration 64 which is adapted for mating coaction with the respective mold cavity insert portions 28, 32 and 30, 32*a* which are mounted on the top of each respective rib section as best seen in FIGS. 5, 6 and 15. In this connection, each of the mold cavity insert portions 28 and 30 and 32, 32*a* likewise has a stepped configuration 66 formed on its lower end, which is adapted for precise mating coaction with the stepped configuration 64 on the respective elongated rib section 46 or 52, in order to interlock the mold cavity insert portions to the respective rib and thus form a smooth surface configuration for formation of the pattern in the respective mold cavity.

Also, as can be best seen in FIGS. 10 and 15, each of the elongated rib sections 46, 52 preferably has adjacent its base portion, a recess 68 running lengthwise of the respective rib section and which is adapted to generally loosely receive therein a relatively short projecting lip 70 on the respective mold cavity insert portion 28*a* and 30*a*, and on the rearwardly disposed mold cavity insert portions 32 and 32*a*, thus further interlocking the mold cavity insert portions in coacting relationship with respect to the elongated rib sections 46, 52 in the mold assembly.

When the insert mold portions 28 through 32*a*, inclusive, are inserted into coacting relationship with respect to the rib sections 46, 52, and the movable mold portions 20, 22, 24 and 24*a* are moved inwardly into engaged abutting relationship with respect to the intermediate mold cavity insert portions, the mold is ready for receiving therein the wax or other destructible material via trough portion 12 which communicates with runway 72 in the front shroud mold portion 22, to introduce the heated destructible material into the mold, thus forming the front and the rear shroud portions 27, 36 and the interconnecting vane portions 33, 33*a*, 33*b* of pattern P. In this connection, it will be seen that there is a stepped mold section 74 mounted on platform 18 and disposed just forwardly of the elongated rib portions 46, 52, which in conjunction with outer mold portion 22 including top plate section 26, provides for molding the front shroud portion 27 of the pattern P. Mold section 74 may be removably fixed to the support platform 18 of the mold assembly.

Each of the mold cavity insert portions 28 to 32*a*, inclusive, is preferably provided with a projecting handle 76 which aids in manipulating the insert cavity mold portions into and from their proper positions in the mold assembly, and likewise the movable mold portions 20, 22, 24 and 24*a* are each preferably provided with handle portions 76*a* which aid in the movement thereof relative to the intermediate mold cavity insert portions. Each of the movable mold portions 20, 22, 24 and 24*a* are preferably mounted on guides, such as, for instance, the guide slots 78 in the platform 18 coacting with a guide projection on the respective mold portion, or the rails 80 on the platform, for guiding the movement of the movable mold portions 20, 22, 24 and 24*a* relative to the rib sections 46, 52 and associated mold portion 74, and the mold cavity insert portions 28–32*a*.

Figure 2:
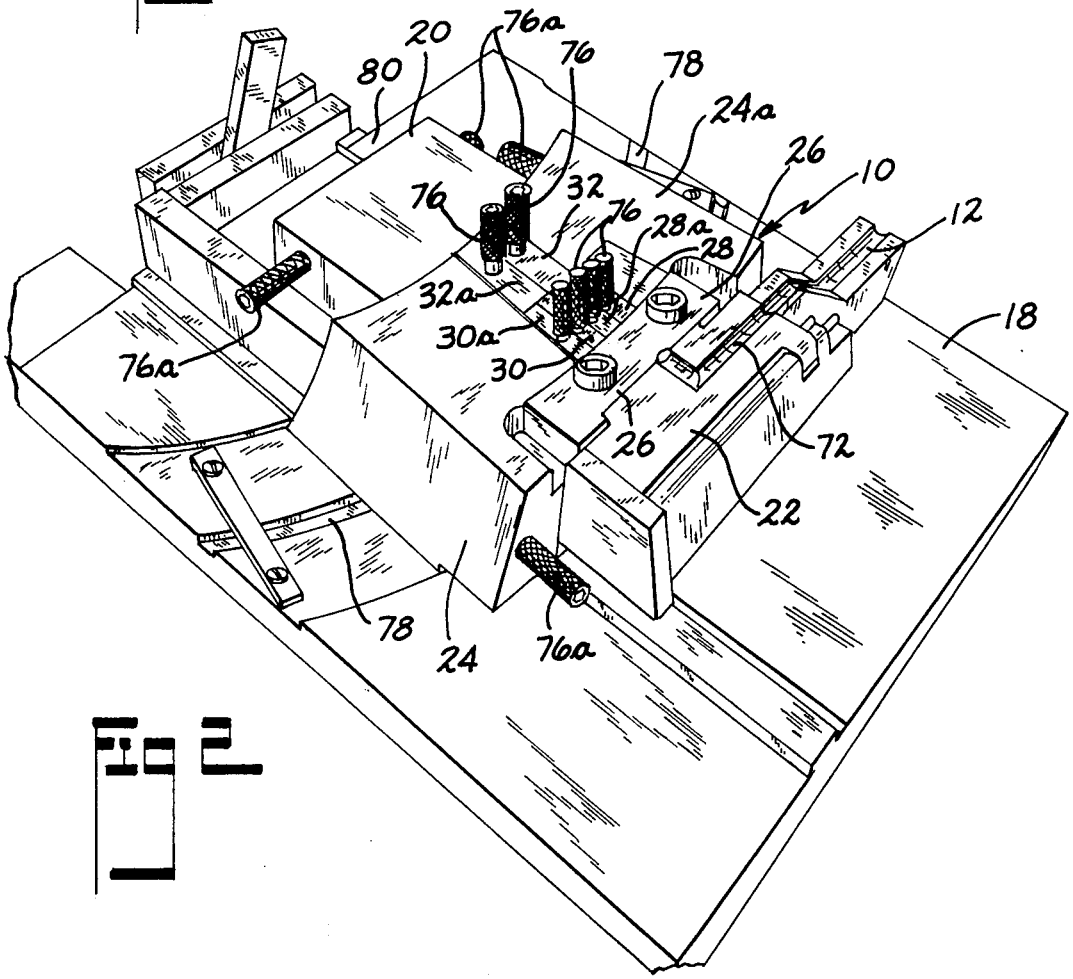
FIG. 2 is an enlarged, perspective illustration of a die mold for molding investment-type casting patterns of irregular shape and showing in perspective illustration the various coacting separable mold portions which define the investment casting mold cavities and with the mold being disposed at a station for disassembly so that the formed investment pattern can be removed from the mold.
Figure 3:
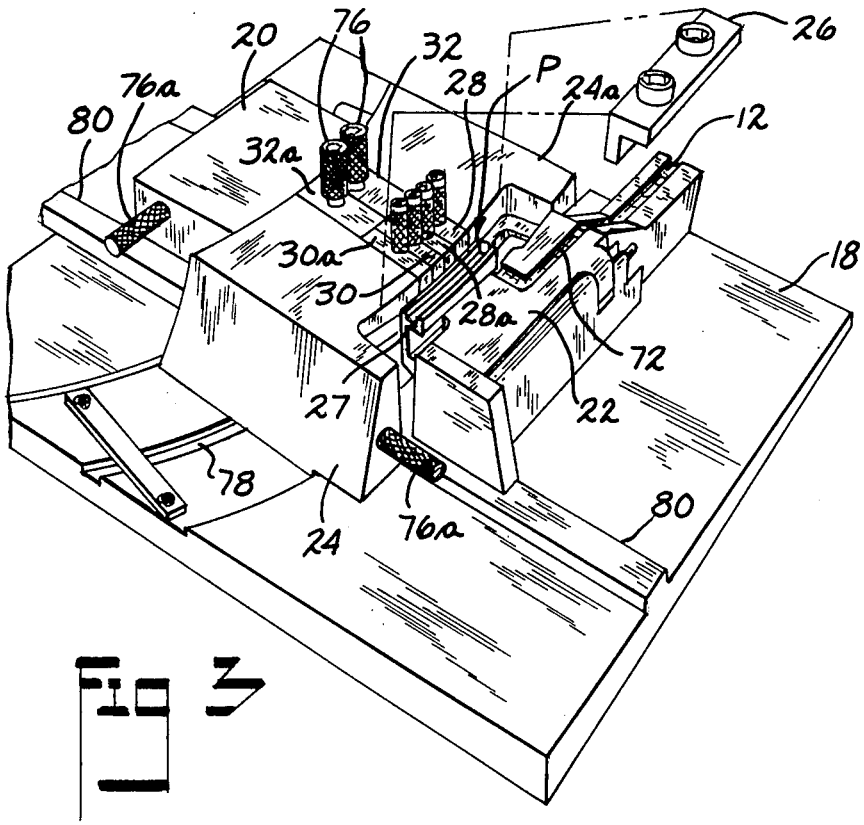
FIG. 3 is a perspective view generally similar to FIG. 2 but illustrating a step in the manual disassembly of the die mold, with the top plate section of the outer shroud molding portion of the die mold having been removed to commence disassembly of the die mold.
Figure 4:
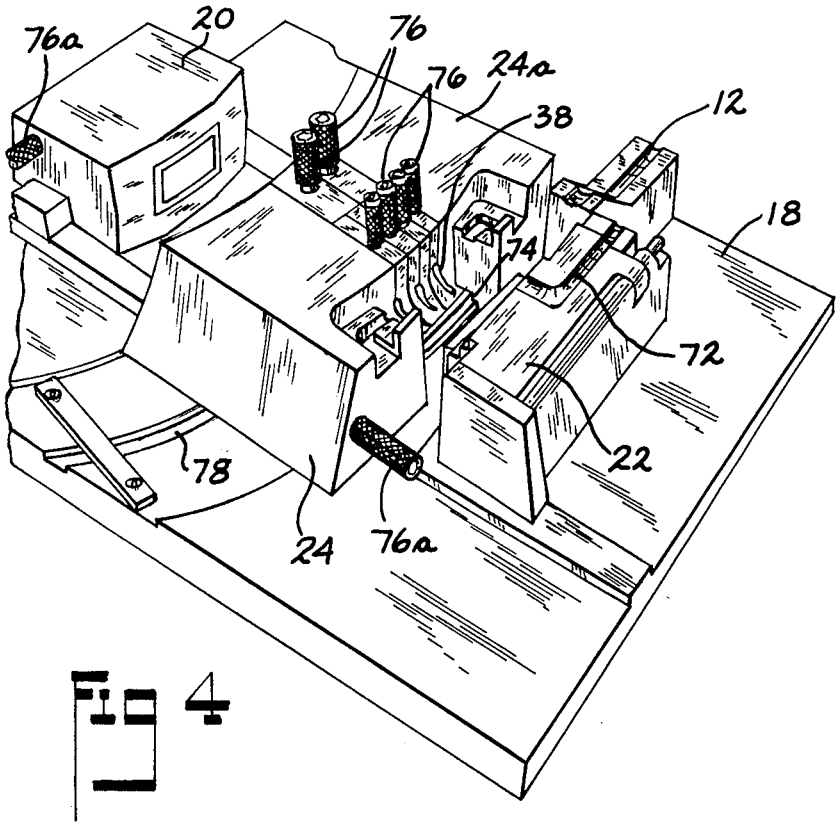
FIG. 4 is a view generally similar to that of FIG. 3 but showing the inner shroud mold portion and the outer shroud mold portion for forming the opposite ends of the investment pattern having been moved outwardly from the remainder of the die mold portions to expose the formed pattern and the front and rear of the mold cavity insert portions disposed intermediate the lateral lefthand and righthand radial end portions of the die mold; the aforementioned formed pattern has been eliminated from this view in the interests of better illustrating the die mold parts.
Figure 7:
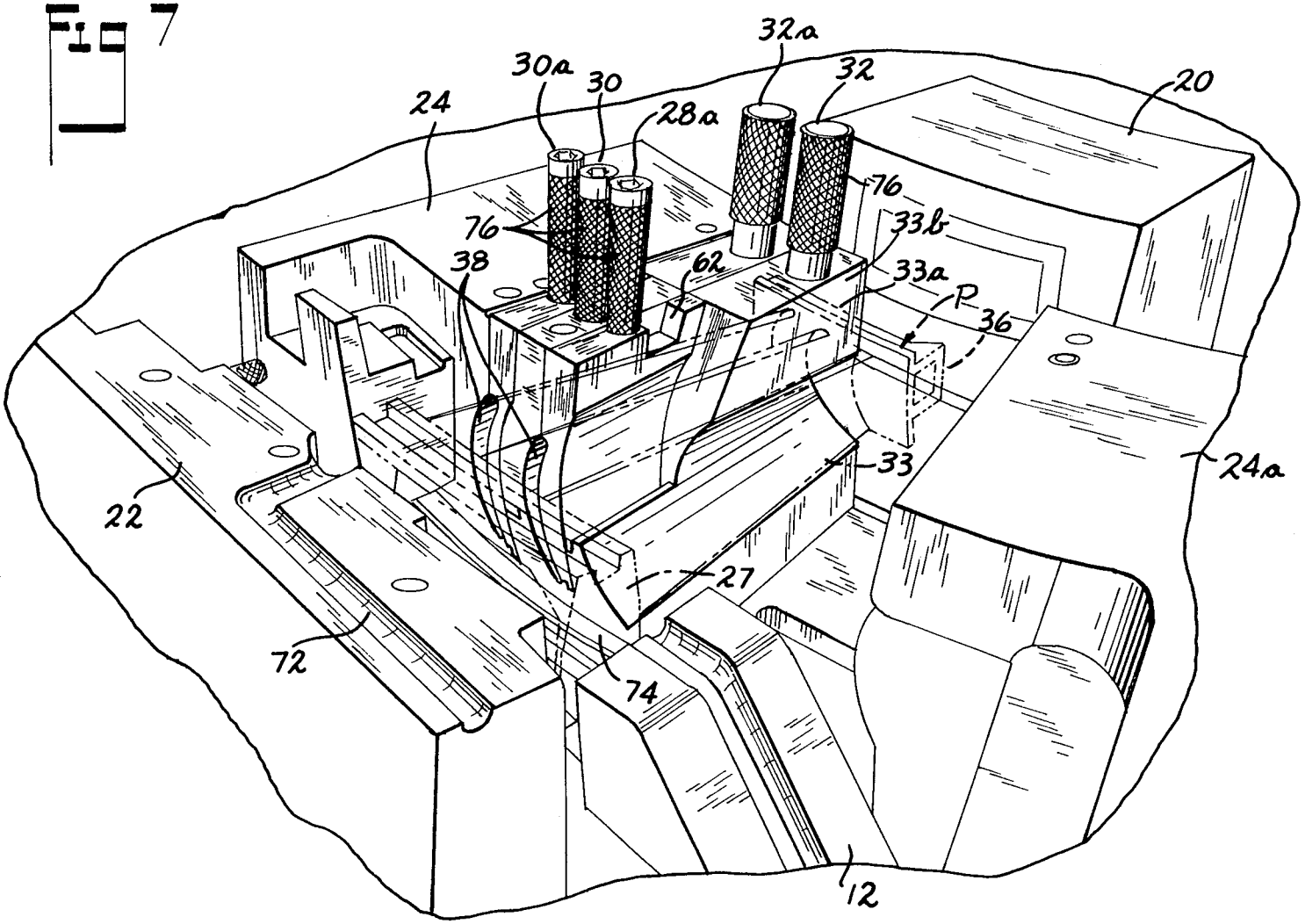
FIG. 7 is a generally perspective view taken from the righthand front corner of the die mold assembly, and illustrating the first cavity insert portion having been removed from the die mold assembly, in the disassembly of the mold to remove the formed pattern. In phantom lines there is shown the investment casting pattern which has been molded in the mold cavity sections of the die mold including the shroud sections of the pattern at the front and rear ends of the irregular shaped vanes of the pattern.

After the formation of the pattern P is accomplished at the injection station A, the mold assembly on the platform 18 can be moved to a disassembly station (e.g. FIG. 2) and the rear and front end mold portions 20, 22 can be moved or slid away from the intermediate mold cavity insert portions 28 to 32*a*, after removal of top plate section 26 (FIG. 3) and then the side mold portion 24*a* is preferably moved or slid away, and as guided, for instance, by its guide trackway slot 78, and thus moved away from the confronting mold cavity insert portions 28, 32, thus exposing a portion of the pattern P as illustrated, for instance, in FIGS. 6 and 7. It will be understood that in FIG. 6 the pattern P has been deleted in the interests of clarity, but FIG. 7 illustrates the position of the pattern P (in phantom lines) in the mold assembly.

The next step in disassembling the mold assembly 10 is preferably to move the mold cavity insert portion 28 arcuately upwardly as shown, for instance, by the curved arrow in FIG. 6 away from the confronting arcuate surface of vane 33 of the pattern P, thus moving cavity insert portion 28 through a generally vertically directed arcuate path to accomplish its removal from the die mold without interfering with the confronting arcuate surface of the vane 33 of the pattern.

It will be seen that the convex surface 56 and complementary coacting concave surface 58 on respectively the mold cavity insert portions 28 and 28*a* enable the arcuate movement of insert portion 28 with respect to the pattern P and with respect to the engaged insert portion 28*a*, without interference. In order to move the insert portion 28 relative to the pattern P, it is preferably first tipped inwardly slightly toward the pattern P, (while the lower stepped end is swung slightly toward the confronting insert portion 28*a*) as insert portion 28 is moved upwardly in its arcuate path. During such movement, the lug or projection 60 on member 28 is moved upwardly out of the receiving recess or slot 62 in the upper end of insert portion 28*a*.

Figure 8:
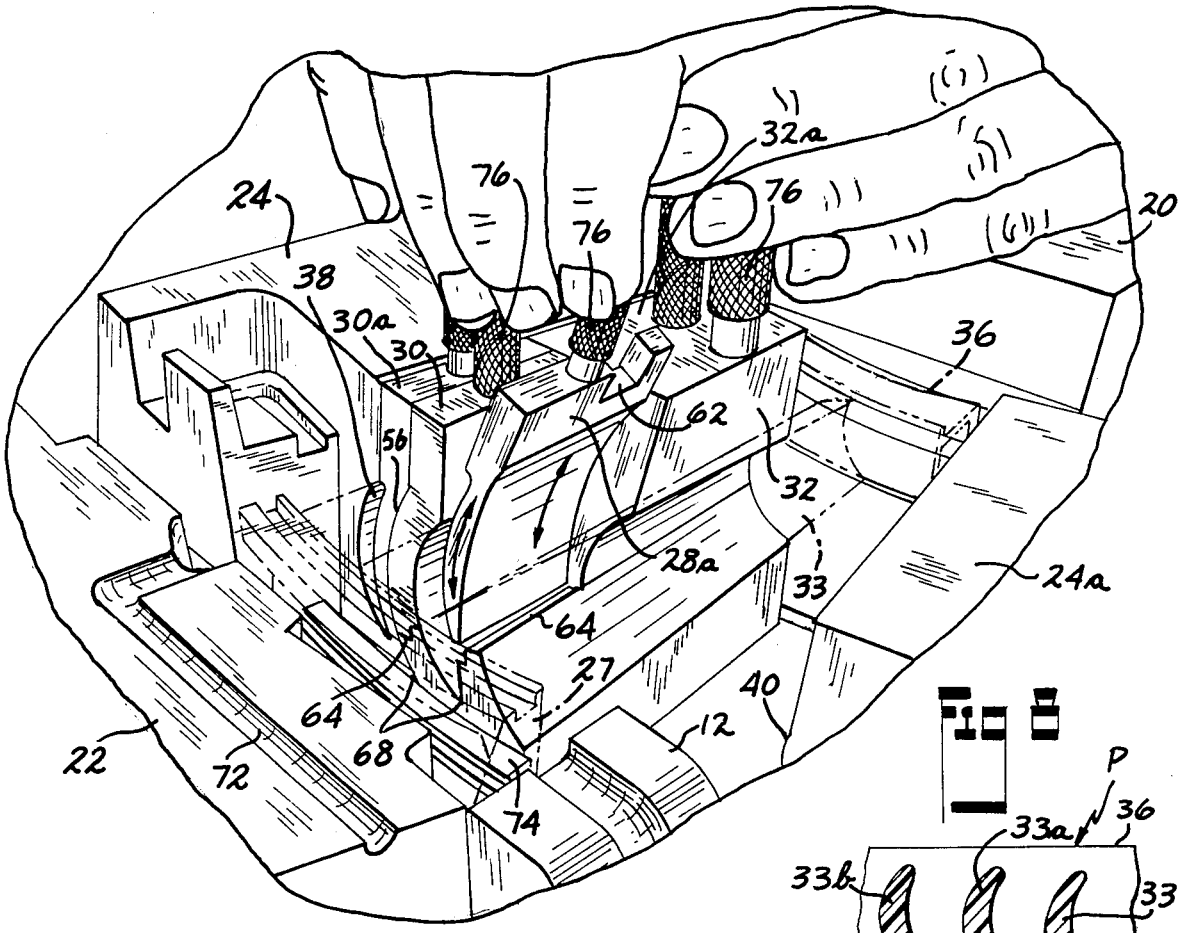
FIG. 8 is a view generally similar to that of FIG. 7 but illustrating the removal of a further adjacent one of the cavity insert portions with respect to the confronting arcuate surface of the vane of the investment pattern, and with respect to the aforementioned associated elongated rib section, and showing the generally arcuate path of movement which such cavity insert portion takes to accomplish removal thereof from the die mold without interference with the formed pattern and the other components of the mold assembly.

Next, insert portion 28*a* is likewise moved in an upward arcuate path of movement, as shown, for instance, in FIG. 8, thereby disengaging the lip 70 thereon from the receiving slot 68 running along the base of the elongated rib section 46, and thus moving the cavity insert portion 28*a* upwardly away from the adjacent vane 33*a* of the pattern P, permitting removal of insert portion 28*a* from the mold assembly without interference with the pattern.

Next, the cavity insert portion 32 is raised upwardly in a generally arcuate path while at the same time is moved generally horizontally linearly toward the forward end of the mold assembly, as shown by the arrows in FIG. 10, so as to clear the vanes 33, 33*a* and thus remove the insert portion 32 upwardly away from the mold assembly without interference, thus completing exposure of the concave side of vane 33*a* and the convex side of vane 33 of the pattern P.

Next, the mold cavity insert portions 30, 30*a* are each selectively and sequentially moved upwardly and arcuately in arcuate paths similarly to that aforediscussed in connection with insert portions 28, 28*a*, and then the rearward insert portion 32*a* is moved forwardly and arcuately upwardly in the manner aforedescribed in connection with insert portion 32, to complete disassembly of the insert portions 30, 30*a* and 32*a* from coaction with the vanes 33*a* and 33*b*.

Next, the mold side portion 24 can be grasped by its handle 76*a* and moved outwardly away from its operative position, and as guided by its guide mechanism 78, to expose the convex side of the vane 33*b* of the pattern P. The pattern can then be removed from coaction with the elongated mold rib sections 46 and 52 by slightly tilting the pattern and moving it in a clockwise direction, and upwardly in a generally arcuate path, thus separating it from the mold assembly, and thus completing the removal of the pattern P from the mold assembly.

The various mold components can be reassembled by reversing the aforedescribed order of removal, so that the insert portions are mounted on their respective elongated rib sections 46, 52, and the front and rear shroud mold portions 20, 22 may be moved inwardly toward the intermediate mold cavity insert portions and associated mold rib sections, while the lateral side mold portions 24, 24*a* may be moved inwardly into engagement with the respective intermediate mold cavity insert portions and stepped mold section 74, to once again assemble the mold for use at the injection station to form another pattern P.

From the foregoing description and accompanying drawings, it will be seen that the invention provides a novel method and a die mold apparatus for molding destructible investment-type casting patterns of irregular shapes which include arcuate in cross section, relatively closely spaced in side-by-side relation vanes or fins, with the die mold including a plurality of separable mold portions including sectional mold cavity insert portions defining arcuate surface sections of the mold cavity, with the defining curvatures of said cavity extending arcuately in generally non-parallel relation, and wherein the mold and the method provide for expeditious removal of the mold cavity insert portions by moving the cavity insert portions in generally arcuate paths and with respect to the formed irregular pattern in the mold assembly, without interference with the pattern, and thus providing for removal of the cavity insert portions from the formed pattern and providing for ultimate removal of the formed pattern from the die mold.

The invention also provides a mold apparatus of the aforementioned type for use in the production of irregular shaped investment-type casting patterns, which includes elongated mold rib sections on a mold assembly base, which defines a predetermined lower section of the mold cavity, and having a plurality of the mold cavity insert portions mounted on the rib sections and defining with said rib sections, an arcuate surface of the mold cavity and thus one arcuate surface of the casting pattern, with means on the mold cavity insert portions and on the rib sections for interlocking the rib sections and the mold cavity insert portions together.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

I claim:

1. In a method for molding investment casting patterns of irregular shapes comprising providing a die mold defining a die mold cavity for the casting pattern with the die mold being comprised of a plurality of separable mold portions, including intermediate sectional mold cavity insert portions defining arcuate surface sections of the mold cavity, with the defining curvatures of said cavity extending arcuately in generally non-parallel relation, and including the step of removing said die mold insert portions from the pattern after the molding thereof, by moving each of the die mold insert portions through a respective generally arcuate path in a predetermined direction, and with respect to the formed pattern, to accomplish removal of said die mold insert portions without interference with the arcuate surfaces of the formed pattern and thus provide for subsequent removal of the latter from the die mold, said mold cavity insert portions including a first insert portion which includes a concave mold cavity defining section and another insert portion which extends alongside of said first insert portion, with said other insert portion and said first insert portion including complementary arcuate mating surfaces extending generally in said predetermined direction, and including as part of said removal step the step of sequentially moving said first insert portion with respect to said other insert portion through an arcuate path defined in general by said mating surfaces, to accomplish removal of said first insert portion from said die mold and then subsequently moving said other insert portion with respect to the pattern through its said arcuate path away from the die mold and the formed pattern, to accomplish sequential removal of said first and said other insert portions from said die mold and the formed pattern.

2. A method in accordance with claim 1 wherein each of said surface sections of the mold cavity extend arcuately normally in a respective generally vertical direction, and wherein the die mold insert portions are each moved in its said generally arcuate path in a generally upward vertical direction for accomplishing removal of said die mold cavity insert portions from the remainder of said die mold, to release said formed pattern.

3. A method in accordance with claim 1 wherein said separable mold portions include an inner shroud mold portion, an outer shroud mold portion, and lateral left and righthand mold portions, and including moving said inner and outer shroud portions and at least one of said left and righthand mold portions laterally away from said cavity insert portions and away from said formed pattern, to permit said removal of said cavity insert portions from said formed pattern.

4. A method in accordance with claim 1 wherein said die mold includes a lower elongated mold rib section defining a predetermined lower concave section of said mold cavity, with said first insert portion being mounted upon said rib section, and wherein the mold cavity is defined in part by said rib section, and said mating first insert portion and other insert portion, said die mold including a plurality of adjacent mold cavities defined by said intermediate mold cavity insert portions, with said other insert portion comprising a convex mold cavity defining surface on the side thereof opposite said mating surface thereof for defining in part an adjacent one of said mold cavities, and wherein said removal step includes tipping of said first insert portion slightly toward the formed pattern while swinging the lower end of said first insert portion slightly toward said other insert portion as said first insert portion is moved upwardly relative to said other insert portion.

5. A method in accordance with claim 4 wherein said rib section on its top surface has a stepped configuration and said first insert portion has a complementary stepped configuration on its lower end, and which are adapted for mating coaction so as to interlock said first insert portion and said rib section together in defining said cavity of the respective die mold.

6. A method in accordance with claim 1 wherein said die mold includes a plurality of said arcuate die mold cavities disposed in side-by-side relation for forming an integral pattern for use in the formation of turbine blades or the like, with each said cavity being defined in part by a coacting pair of said first and other insert portions, positioned on the respective said rib section, and wherein said removal step includes the sequential arcuate path removal of each insert portion with respect to the respective mold cavity and formed pattern therein and with respect to the rest of the insert portions and their respective cavities and formed pattern therein, commencing with said first insert portion, to expose the pattern for removal from said mold.

7. In a method for molding investment casting patterns of irregular shapes comprising providing a die mold defining a die mold cavity for the casting pattern with the die mold being comprised of a plurality of separable mold portions, including intermediate sectional mold cavity insert portions defining arcuate surface sections of the mold cavity, with the defining curvatures of said cavity extending arcuately in generally non-parallel relation, and including the step of removing said die mold insert portions from the pattern after the molding thereof, by moving each of the die mold insert portions through a respective generally arcuate path in a predetermined direction, and with respect to the formed pattern to accomplish removal of said die mold insert portions without interference with the arcuate surfaces of the formed pattern and thus provide for subsequent removal of the latter from the die mold, said mold including a lower elongated mold rib section defining a predetermined lower concave section of said mold cavity, said mold cavity insert portions including a first insert portion which includes a concave mold cavity defining section with said first insert portion being mounted upon said rib section, and another insert portion which extends alongside of said first insert portion and said rib section with said other insert portion and said first insert portion including complementary arcuate mating surfaces wherein the mold cavity is defined in part by said rib section and said mating first insert portion and said other insert portion, and wherein said removing step includes sequentially moving said first insert portion and then said other insert portion through said their respective arcuate paths and away from said rib section to accomplish removal of said first and said other insert portions from said die mold, and wherein said rib section on its top surface has a stepped configuration and said first insert portion has a complementary stepped configuration on its lower end which are adapted for mating coaction so as to interlock said first insert portion and said rib section together in defining said cavity of said die mold, and wherein said other insert portion on its lower end includes a projecting lip portion which is adapted to be received within a slot running alongside said rib section so as to interlock said other insert portion relative to said rib section and said first insert portion, said arcuate mating surfaces on said first insert portion and said other insert portion providing for and defining said arcuate path removal movement of said first insert portion with respect to the pattern and with respect to the other insert portion during removal of said insert portions from said pattern to permit removal of the latter from the die mold.

8. An investment casting die mold for molding investment-type casting patterns of irregular shape and wherein the die mold defining a plurality of side-by-side die mold cavities for the casting pattern in comprised of a base and a plurality of separable movable outer mold portions that can be moved on said base outwardly relative to one another and relative to movable intermediate sectional mold cavity insert portions disposed between and held in operative positioned by at least certain of the first mentioned separable mold portions, for defining arcuate surface sections of the respective mold cavity, with the defining curvatures of each respective mold cavity extending arcuately in a predetermined direction in generally non-parallel relation, said mold cavity insert portions comprising a plurality of generally juxtaposed mold block members which on at least one surface thereof of each mold block member there is defined the arcuate curvature of the casting pattern, said juxtaposed mold block members including a first insert portion comprising a concave mold cavity defining section and being mounted on an associated rib section of the die mold, and another insert portion which extends alongside of said first insert portion and said rib section, with said other insert portion and said first insert portion including complementary arcuate mating surfaces extending generally in said direction and disposed in juxtaposed relation, said other insert portion comprising a convex cavity defining surface on the side opposite said mating surface thereof for defining in part an adjacent one of said cavities, and said concave defining section of said first insert portion and said rib section defining an arcuate surface of another of said mold cavities, removal of said insert portions from the pattern is accomplished after the molding thereof and after outward movement of at least certain of the first mentioned separable mold portions relative to one another and relative to said mold block members by moving each insert portion sequentially in a respective generally arcuate path in said direction commencing with said first insert portion and without interference with the pattern, thus providing for the subsequent removal of the latter from the die mold, said path of removal of said first insert portion being determined by said mating surfaces, and wherein each said cavity insert portion includes means for gripping by a workman for selective removal thereof in its said generally arcuate path.

9. A mold in accordance with claim 6 wherein said first insert portion on its lower end includes a stepped configuration adapted for interlocking coaction with a complementary configuration on said rib section mounted to said base, said first insert portion being separable from said rib section via its said arcuate path of removal movement in a generally vertically upward direction.

10. A mold in accordance with claim 7 including means on the lower end of both said first insert portion and said other insert portion for releasably interlocking said first and other insert portions relative to said rib section, and means on said first and other insert portions for releasably interlocking the latter together.

11. An investment casting die mold for molding investment-type casting patterns of irregular shape and wherein the die mold defining the die mold cavity for the casting pattern is comprised of a base and a plurality of separable movable outer mold portions that can be moved on said base outwardly relative to one another and relative to movable intermediate sectional mold cavity insert portions disposed between and held in operative position by at least certain of the first mentioned separable mold portions, for defining arcuate surface sections of the mold cavity, with the defining curvatures of the mold cavity extending arcuately in generally non-parallel relation, said mold cavity insert portions comprising a plurality of generally juxtaposed mold block members which on at least one surface thereof of each mold block member there is defined the arcuate curvature of the respective casting pattern, removal of said cavity insert portions from the pattern is accomplished after the molding thereof and after outward movement of at least certain of the first mentioned separable mold portions relative to one another and relative to said mold block members by moving each mold cavity insert portion sequentially in a respective generally arcuate path in a predetermined direction and without interference with the pattern, thus providing for the subsequent removal of the latter from the die mold, and wherein each said cavity insert portion includes means for gripping by a workman for removal thereof in said generally arcuate path, and including a lower elongated mold rib section on said base defining a predetermined lower section of the respective cavity, each of said juxtaposed mold block members including a concave cavity defining section with said block members being mounted on said rib section whereby said rib section and said mold block members define in part said mold cavity and one arcuate surface of the casting pattern, and means on said mold block members and on said rib section for interlocking said rib section and said mold block members, and wherein the casting pattern is adapted for incorporation into an air foil part such as a blade of a turbine or the like, said die mold including a plurality of mold cavities defined by said intermediate mold cavity insert portions which includes a first insert portion comprising a concave cavity defining section and being mounted on said rib section, and another insert portion which extends alongside of said first insert portion and said rib section, with said other insert portion and said first insert portion including complementary arcuate mating surfaces disposed in juxtaposed relation, said other insert portion comprising a convex cavity defining surface on the side opposite said mating surface thereof for defining an adjacent one of said cavities, and said concave cavity defining section of said first insert portion and said rib section defining an arcuate surface of another of said cavities.

12. A mold in accordance with claim 11 wherein certain of said outer mold portions respectively define inner and outer shrouds for the casting pattern, said certain mold portions being movable linearly relative to said base to separate said certain mold portions from the pattern in the process of removing the pattern from the die mold.

13. A mold in accordance with claim 12 wherein at least one vane of the pattern is defined on one side thereof by said rib section and said mounted mold block members and on the other side thereof by one of said outer mold portions having a lengthwise extending arcuate mold cavity defining surface thereon which when mated with the mold cavity defining surfaces on said rib section and said mounted mold block members defines the mold cavity for forming the vane of the pattern.

14. A mold in accordance with claim 13 including stepped interlocking means coacting between said rib section and said mounted mold block members for positioning the latter relative to one another transversely of the mold cavity.

* * * * *